United States Patent [19]

Rinkavage

[11] Patent Number: 5,067,724

[45] Date of Patent: Nov. 26, 1991

[54] METHOD OF PLAYING A POKER GAME

[76] Inventor: Raymond M. Rinkavage, 3E Queen Tr., Southington, Conn. 06489

[21] Appl. No.: 622,624

[22] Filed: Dec. 5, 1990

[51] Int. Cl.[5] ..... A63F 1/00

[52] U.S. Cl. ..... 273/292; 273/295; 273/DIG. 30

[58] Field of Search ..... 273/292, 293, 295, 303–305, 273/307, DIG. 30

[56] References Cited

U.S. PATENT DOCUMENTS

| | | | |
|---|---|---|---|
| 2,369,804 | 2/1945 | Schoolfield et al. | 273/DIG. 30 |
| 4,478,417 | 10/1984 | Shamsid-Deen | 273/295 |
| 4,591,162 | 5/1986 | Fakhoury | 273/303 |
| 4,807,885 | 2/1989 | Chamblee et al. | 273/292 |

OTHER PUBLICATIONS

Scarne, John, "Scarne's Encyclopedia of Games," Harper & Row Publishers, pp. 570–571, 1973.

*Primary Examiner*—Benjamin Layno
*Attorney, Agent, or Firm*—Leon Gilden

[57] ABSTRACT

A method for playing a poker-type card game in which distributed cards by a dealer are sequentially bid by sequential players, wherein each bid is defined by a number of like cards held by each bidder or believed to be held by opposing players, whereupon each bid if successful awards a bidding player a predetermined amount of money from each opposing player, wherein such bid is challenged by an opposing player successfully, a bidding player must pay each opposing player an equal predetermined amount of currency.

4 Claims, 2 Drawing Sheets

METHOD OF PLAYING A POKER GAME

BACKGROUND OF THE INVENTION

1. Field of the Invention

The field of invention relates to poker-type games, and more particularly pertains to a new and improved method of playing a poker game wherein the same requires successive bidding and challenging of a series of cards believed to be held by each player in conjunction with cards held by opposing players.

2. Description of the Prior Art

Poker type games of various types have been utilized and presented in the prior art. U.S. Pat. No. 4,648,604 to Horan sets forth a method of playing draw poker, wherein cards utilized in previous hands are removed from play and a time limit imposed for completion of a further predetermined number of poker hands to be played.

U.S. Pat. No. 4,836,553 to Suttle sets forth a card game wherein each player is present five cards, wherein an ace-king combination or better of cards presented to each player effects a winning combination of cards dependent upon subjective rules of the game.

U.S. Pat. No. 4,614,342 to Takashima sets forth an electronic game machine utilized in playing of poker-type games.

U.S. Pat. No. 3,876,208 to Wachtler, et al. and U.S. Pat. No. 4,743,022 to Wood are further examples of gaming machines utilized in playing poker-type games.

As such, it may be appreciated that there continues to be a need for a new and improved method of playing a poker game which addresses both the problems of ease of use as well as effectiveness in plays to provide amusement and entertainment of individuals and in this respect, the present invention substantially fulfills this need.

SUMMARY OF THE INVENTION

In view of the foregoing disadvantages inherent in the known types of poker games now present in the prior art, the present invention provides a method of playing a poker game wherein the same sets forth generic cards of varying numerical value to permit conjecture as to like number of numerical cards held by each player and opposing players as a basis for gaming. As such, the general purpose of the present invention, which will be described subsequently in greater detail, is to provide a new and improved method of playing a poker game which has all the advantages of the prior art poker games and none of the disadvantages.

To attain this, the present invention provides a method for playing a poker-type card game in which distributed cards by a dealer are sequentially bid by sequential players, wherein each bid is defined by a number of like cards held by each bidder or believed to be held by opposing players, whereupon each bid if successful awards a bidding player a predetermined amount of money from each opposing player, wherein such bid is challenged by an opposing player successfully and a bidding player must pay each opposing player an equal predetermined amount of currency.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved method of playing a poker game which has all the advantages of the prior art poker games and none of the disadvantages.

It is another object of the present invention to provide a new and improved method of playing a poker game and associated structure which may be easily and efficiently manufactured and marketed.

It is a further object of the present invention to provide a new and improved method of playing a poker game and associated structure which is of a durable and reliable construction.

An even further object of the present invention is to provide a new and improved method of playing a poker game and associated structure which is susceptible of a low cost of manufacture with regard to both materials and labor, and which accordingly is then susceptible of low prices of sale to the consuming public, thereby making such methods of playing poker games and associated structure economically available to the buying public.

Still yet another object of the present invention is to provide a new and improved method of playing a poker game and associated structure which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
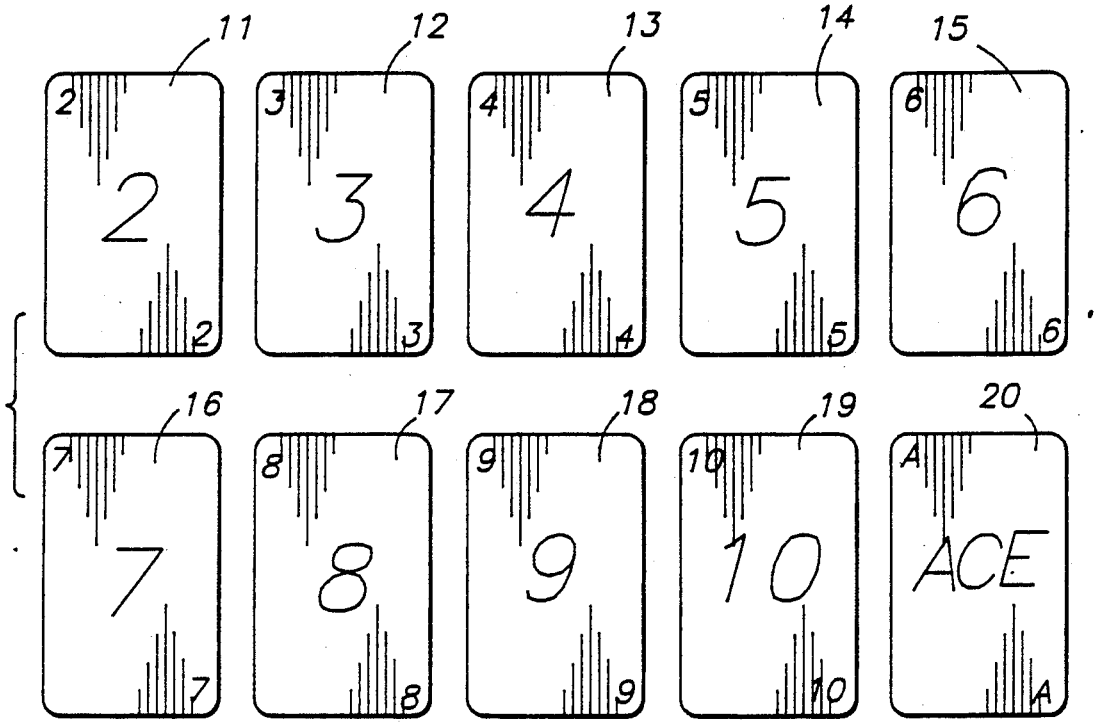
FIG. 1 is a top orthographic view of a representative set of cards utilized by the instant invention of a plurality of such sets utilized to define a deck of cards.
Figure 2:
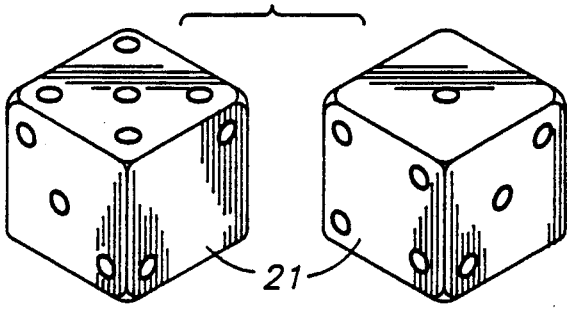
FIG. 2 is an isometric illustration of a plurality of dice utilized by the instant invention.
Figure 3:
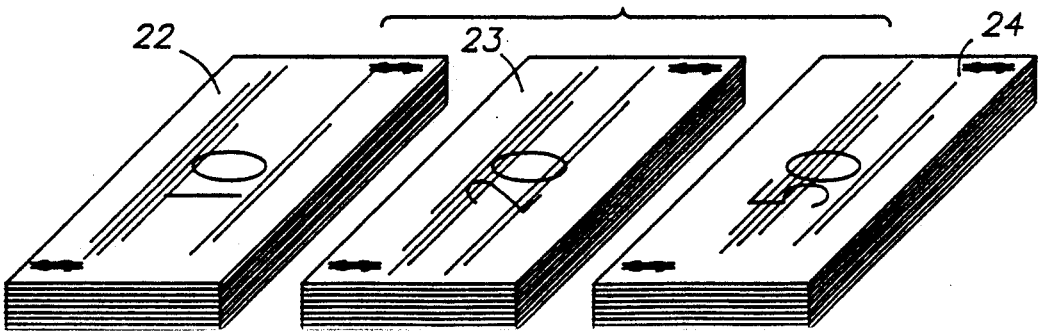
FIG. 3 is an isometric illustration of currency denominations utilized by the instant invention.

With reference now to the drawings, and in particular to FIGS. 1 to 6 thereof, a new and improved method of playing a poker game embodying the principles and concepts of the present invention and generally designated by the reference numerals 10–26 will be described.

More specifically, the method of playing a poker game as set forth by the instant invention essentially comprises providing a deck of cards to include at least ten sets of ten cards, as illustrated in FIG. 1, from a numerical 2 through numerical 10, and to an ace in ascending order of value. A deck of cards so formed is without any suit, but comprised completely of such numerical cards as set forth above and illustrated in FIG. 1, of cards 11–20 of 2-ace respectively. A plurality of dice 21 are utilized, wherein each player of a plurality of players in the playing of game throws a dice pair 21 to determine sequential play of each players, wherein a highest total determines a dealer, a second highest total determines a player to make a bid or challenge in the play of the game in sequential order based upon descending order of value by each player provided by throwing of the dice pair 21. Currency is provided and awarded each player defined by a first currency denomination 22 comprised of representative ten dollars, second currency denomination 23 comprised of a stack of twenty representative dollars, and a third currency denomination 24 comprised of a stack of fifty representative dollars each. After a dealer being determined, each player is dealt eight playing cards or similar number from a shuffled deck comprising the ten sets of ten cards, each set as illustrated in FIG. 1. Subsequently each player is provided a betting sum defined by the equation $C=50+X$ (50) where C equals currency amount provided each player and X equals the number of players in excess of two players such that two players each receive fifty dollars, three players receive one hundred dollars, four players receive one hundred fifty dollars, and so forth.

Rules of the Game

1. A bid includes declaring of a "poker hand" (including one of a kind, two of a kind, etc , such as two threes, two fours, and the like).

2. It should be noted that two is the lowest value in successively increasingly values to the three, four, five, six, seven, eight, nine, and ace, wherein the ace is of the greatest value. It is understood there are no suits in the assembled deck of cards, merely the aforenoted designated cards 11–20 and multiples thereof.

3. Each successive player must make a bid higher than a previous player bid. For example, if a previous player has declared three twos of the cards 11, a successive player must either challenge that bid or bid a higher bid, such as three threes.

4. A player is not eliminated from a dealt hand by losing a challenging bid wherein all players are employed and must challenge a bid to bring a hand to its termination.

5. There are no straights, flushes, or full houses such as is typically associated with a conventional poker game.

6. Cards are not displayed until the highest bid has been challenged by all the other players. At that time, all cards are laid down in front of the respective players and a total count is taken of the denomination bid. For example is the final bid was seven fives and there are a total of five fives, then that challenge of that player bidding the seven fives loses and must pay each player a predetermined denomination, such as a first currency denomination 22, such as ten dollars. If that bid is successful wherein there are seven of the number five cards 14 by the bidding player and within the hands of all remaining players, that bid is successful and paid the at least first currency denomination 22 by each of the other players. When a bidding player has been challenged by all of the players, that bidding player may opt to bid once again to a higher level, such as from five sevens to seven sevens and the other players may again bid or challenge to either accede or merely challenge the latest bid.

9. The only bid that must effect showing of the bidding player's hand is the highest bid, and only if all remaining players have challenged that bid.

A winner is declared when all players, except one player, has lost all of the initially provided sum of currency of upon exceeding a predetermined time limit set, wherein the player with the most accumulated currency of the currency denominations 22, 23, 24 is declared a winner.

Example Game 1 hand: 3, 9, 5, 6, A, 8, 5, 9
2 hand: 2, 8, 3, 9, 10, 6, 2, 9
3 hand: 7, A, 7, 8, 5, 3, 6, 6
4 hand: 4, 3, 2, 9, 9, 10, 3 A Player #1 may want to start out with a bid of two 8's, although he has only one 8 in his hand he is taking a chance that no one will challenge this small bid. Even if someone did challenge this early, he would be safe because players 2 and 3 also had 8's for a total of three 8's. His bid was only two 8's.

The second player does not challenge and therefore must bid higher than two 8's. Player #2 bids three 2's. He already has two 2's in his hand and he is chancing that amongst the other players will be the third 2 to complete his bid, if he is challenged by all the other players.

Player #3 does not challenge and bids four 7's. He has two 7's in his hand and would be looking for the third.

Player #4 feels confident with the two nines in his hand and stretches the bid to four 9's.

Player #1 ups the bid to five 9's.
Player #2 "CHALLENGES".
Player #3 "CHALLENGES".

Player #4 bids six 9's.

Players #1, 2, and 3 all challenge the #4 bid of six nines.

The total number of nines held by all players was six. Two held by #1, two held by #2, and two held by player #4 for a total of six nines, exactly what was bid. Player #4 validated his bid and receives $20.00 from each challenger.

If that total number of nines held by all players was less than six nines, then player number four would have had to pay all his challengers $10.00 each.

Figure 4:
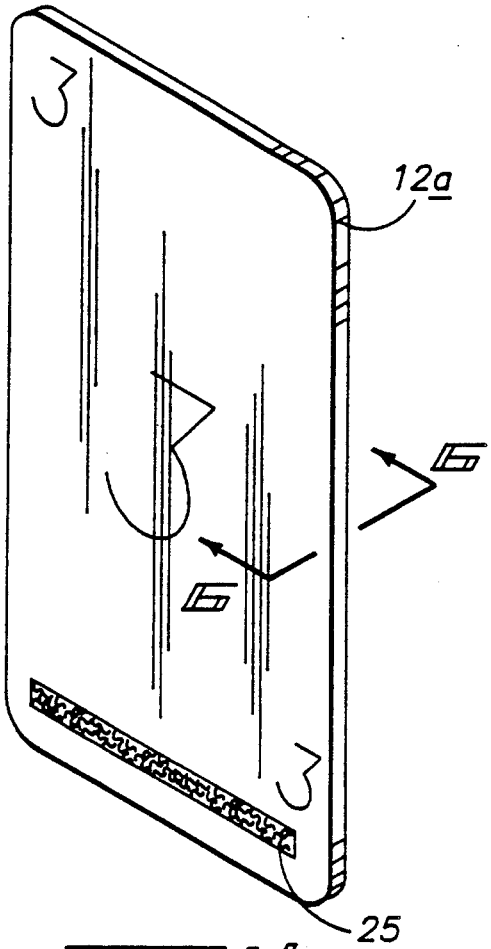
FIG. 4 is an isometric illustration of a modified card utilized in the deck of cards in the instant invention.
Figure 6:
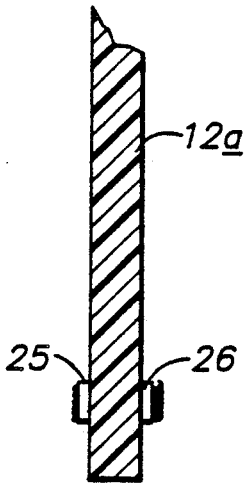
FIG. 6 is an orthographic view, taken along the lines 6—6 of FIG. 4, in the direction indicated by the arrows.
Figure 5:
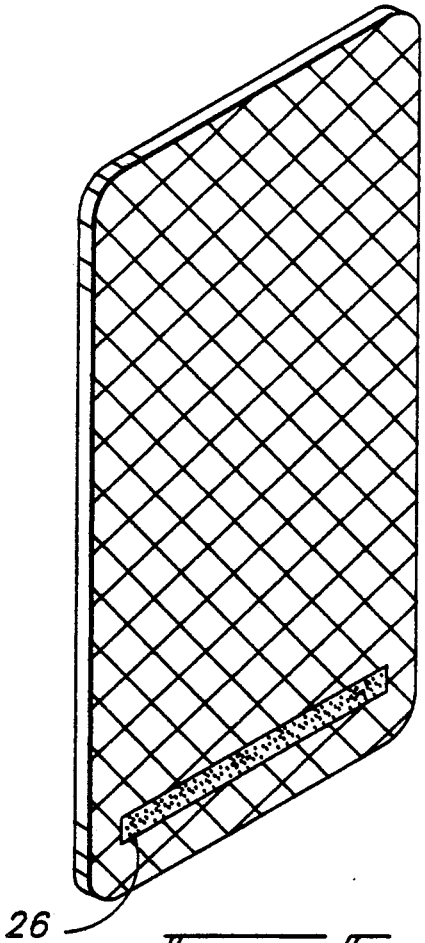
FIG. 5 is an isometric rear illustration of the card, as set forth in FIG. 4.

FIGS. 4–6 illustrate the use in the compilation of a deck of cards, wherein each card includes fastening means as exemplified by the card 12*a* as set forth in FIGS. 4–6. The card 12*a* includes a forward connector strip 25 and a rear connector strip 26. The forward connector strip and rear connector strip are each coextensively arranged relative to one another on a respective forward and rear surface of each card. The forward connector strip includes hook fasteners of a fabric connector fastening means, and the rear connector strips include loop fasteners such that cards stacked upon one another are secured and aligned as each card requires the same predetermined spacing of each connector strip relative to a bottom edge of each card for ease of storage and positioning of a card hand, such that the cards may be somewhat offset relative to one another in a single line and held by each player.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of playing a poker game, including a plurality of players, comprising the steps of, providing a deck of cards, including a plurality of identical sets of a predetermined number of cards, each card in each identical set having a distinguishable numerical value and each identical set of cards representing numerals in ascending order and providing each player with a predetermined amount of currency, and selecting a dealer from a plurality of players, and the dealer distributing a finite number of cards to each of the plurality of players, wherein the finite number of cards is less than ten percent of the number of cards in the deck of cards, and each player in turn announces a bid of a predetermined number of like numbered cards based on a first number of the like number of cards held by each player and a second number of the like number of cards based on speculation to be held by remaining players of the plurality of players, and opposing players selectively challenging the bid or selectively presenting a further bid defining a further number of cards greater than the group of like numbered cards, wherein said each player by correctly substantiating the bid subject to the challenge receives from each player a penalty number of currency or alternatively, upon not substantiating the bid, pays each remaining player of the plurality of players the predetermined number of currency dollars.

2. A method as set forth in claim 1 wherein the predetermined amount of currency provided each player is determined by an equation where $C=50+X$ (50), and where C equals a predetermined amount of currency, and X equals players of the plurality of players in excess of two.

3. A method as set forth in claim 1 wherein the step of providing a deck of cards includes defining the plurality of sets as ten, and the predetermined number of cards as ten, wherein each of the ten sets includes a card designating two, a card designating three, a card designating four, a card designating five, a card designating six, a card designating seven, a card designating eight, a card designating nine, a card designating ten and a card designating ace.

4. A method as set forth in claim 3 wherein the step of providing a deck of cards includes the step of forming each card with a forward surface and a rear surface, wherein the forward surface includes a first fabric connector strip, including a matrix of hooks formed thereon defined by a predetermined length and spaced from a bottom edge of the card a predetermined spacing, and forming a second connector strip on the rear surface of the card, wherein the second connector strip includes a matrix of fabric loops mounted on the second connector strip, and wherein the second connector strip is defined by the predetermined length and spaced from the bottom edge of the card the predetermined spacing to permit ease of assemblage of the cards.

* * * * *